US006193582B1

(12) United States Patent
Gleim

(10) Patent No.: US 6,193,582 B1
(45) Date of Patent: Feb. 27, 2001

(54) SHOCK ABSORBER FOR TOY VEHICLES

(75) Inventor: Robert Gleim, Royersford, PA (US)

(73) Assignee: Connector Set Limited Partnership, Hatfield, PA (US)

( * ) Notice: Subject to any disclaimer, the term of this patent is extended or adjusted under 35 U.S.C. 154(b) by 0 days.

(21) Appl. No.: 09/379,829

(22) Filed: Aug. 24, 1999

(51) Int. Cl.[7] ..... A63H 17/26
(52) U.S. Cl. ..... 446/466; 188/129; 267/134
(58) Field of Search ..... 446/469, 471, 446/466, 448, 465; 188/129; 267/134

(56) References Cited

U.S. PATENT DOCUMENTS

| | | | |
|---|---|---|---|
| D. 311,942 | 11/1990 | Dideriksen . | |
| 2,002,100 | 5/1935 | Smith . | |
| 2,690,818 | 10/1954 | Janeway . | |
| 2,703,156 | 3/1955 | Depallens | 188/129 |
| 3,327,814 | 6/1967 | Nickell | 188/129 |
| 3,332,523 | 7/1967 | Chambers | 188/129 |
| 3,510,979 | 5/1970 | Fischer . | |
| 3,718,326 | 2/1973 | Ristau | 188/129 |
| 4,696,655 | 9/1987 | D'Andrade et al. | 446/466 |
| 4,760,985 | 8/1988 | Stewart et al. | 248/176 |
| 4,919,639 | 4/1990 | Hesse | 446/462 |
| 5,083,454 | 1/1992 | Yopp . | |
| 5,090,934 | 2/1992 | Quercetti | 446/471 |
| 5,096,452 | 3/1992 | Wagener | 446/469 |
| 5,280,848 | 1/1994 | Moore . | |
| 5,322,469 | 6/1994 | Tilbor . | |
| 5,338,247 | 8/1994 | Miles | 446/466 |
| 5,380,231 | 1/1995 | Brovelli | 446/6 |
| 5,427,558 | 6/1995 | Knudsen et al. . | |
| 5,934,419 | 8/1999 | Riad | 188/129 |

*Primary Examiner*—Jacob K. Ackun
*Assistant Examiner*—Urszula M. Cegielnik
(74) *Attorney, Agent, or Firm*—Schweitzer Cornman Gross & Bondell LLP

(57) ABSTRACT

A two-part shock absorber device for toy vehicles is comprised of a sleeve part and a strut part, each formed of molded plastic material. The strut element is received within an internal cavity of the sleeve for axial extending and retracting movement. The upper end of the sleeve cavity is progressively constricted, and cooperates with a pair of upwardly extending spring tines fixed in cantilever fashion to the upper end of the strut. The squeezing of the spring tines within the constriction of the sleeve provides progressively increasing resistance to axial compression of the strut into the sleeve and also provides spring action for return of the strut to its normal axial extended position. A simulated coil spring, molded on the outside of the strut element provides for realistic simulation of the operation of a shock absorber.

8 Claims, 2 Drawing Sheets

SHOCK ABSORBER FOR TOY VEHICLES

BACKGROUND AND SUMMARY OF THE INVENTION

The present invention relates to a shock absorber device for toy vehicles, and more particularly to a novel, two-part shock absorber device, of molded plastic construction, intended for use in connection with toy vehicles of various types. The invention is particularly useful in connection with construction toy building sets, such as those sold under the K'NEX trademark, but is not necessarily limited thereto.

In an effort to lend increased realism to toy vehicles, designers may desire to incorporate shock absorber-like elements in the wheel suspension systems for such vehicles. The device of the present invention provides a simplified, economical, two-part shock absorber device with telescopically movable parts, providing a highly realistic looking shock absorber element which, in addition, functions to provide an elastic suspension characteristic to a vehicle in which it is incorporated.

Pursuant to the invention, a novel shock absorber device is comprised of two parts, a strut and a sleeve, with the strut being telescopically received within and guided for axial movement by the sleeve. The upper end of the sleeve, and the lower end of the strut, are provided with bearings or similar structural elements enabling them to be incorporated into the vehicle structure in the manner desired.

In a particularly preferred embodiment of the invention, the upper end of the strut element, which is telescopically received within the sleeve element, is provided with a pair of upwardly extending resiliently displaceable tine elements arranged for cooperation with a progressively convergent upper recess portion in the sleeve element. As the strut element moves upwardly into the sleeve, the resiliently displaceable tine elements engage and are displaced inwardly by the convergent portion of the recess, imparting progressively increasing resistance to continued upward movement of the strut. When the upward force acting on the strut is removed, the resiliently displaceable tine elements urge the strut in the opposite direction, toward its normal, fully extended position.

Although the strut advantageously is a one-piece plastic molding, the lower portion thereof advantageously is molded in the form of a coil spring positioned concentrically about a strut rod. The upper portion of the coil spring molding is telescopically received within the sleeve, providing an illusion of a coil spring performing a mechanical function.

For a more complete understanding of the above and other features and advantages of the invention, reference should be made to the following detailed description of a preferred embodiment of the invention and to the accompanying drawings.

DESCRIPTION OF PREFERRED EMBODIMENTS

Figure 1:
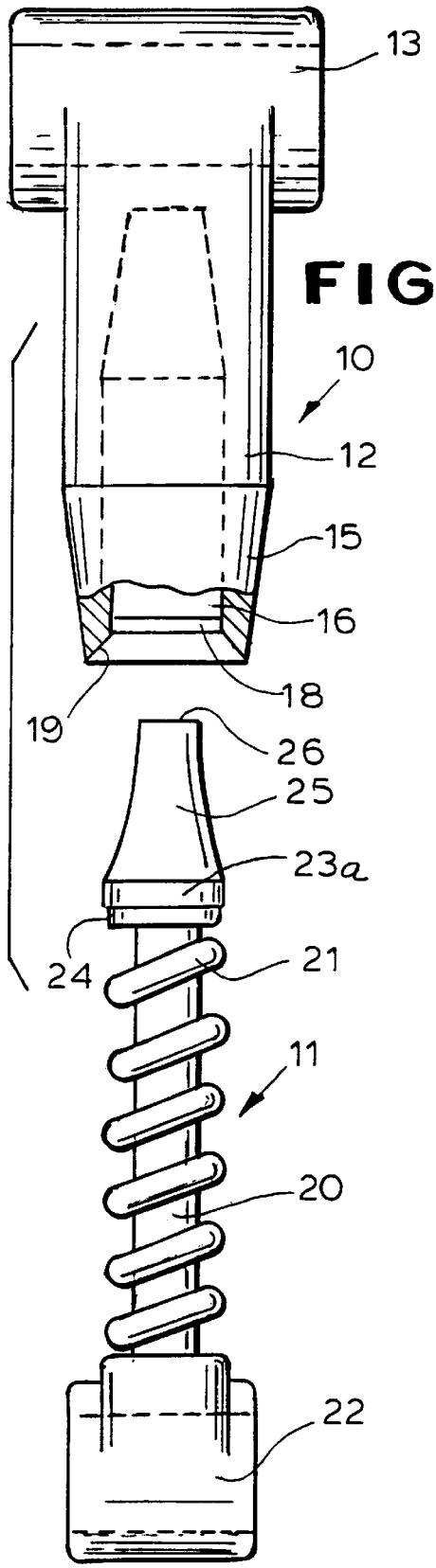
FIG. 1 is an exploded front elevational view of a shock absorber device according to the invention, with telescopically associated parts shown in separated relationship.
Figure 2:
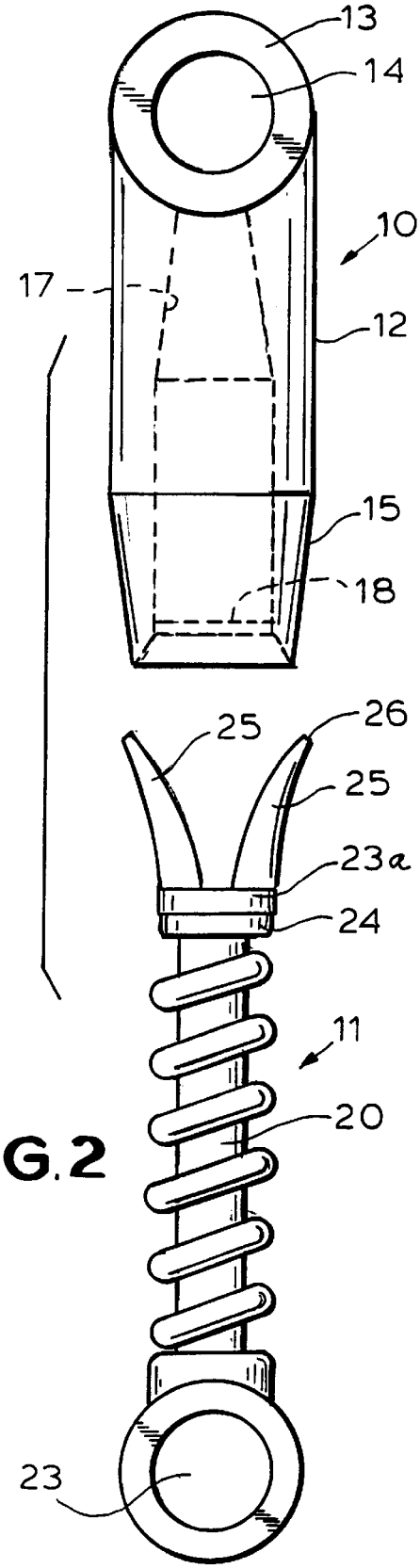
FIG. 2 is an exploded side elevational view of the elements shown in FIG. 1.
Figure 3:
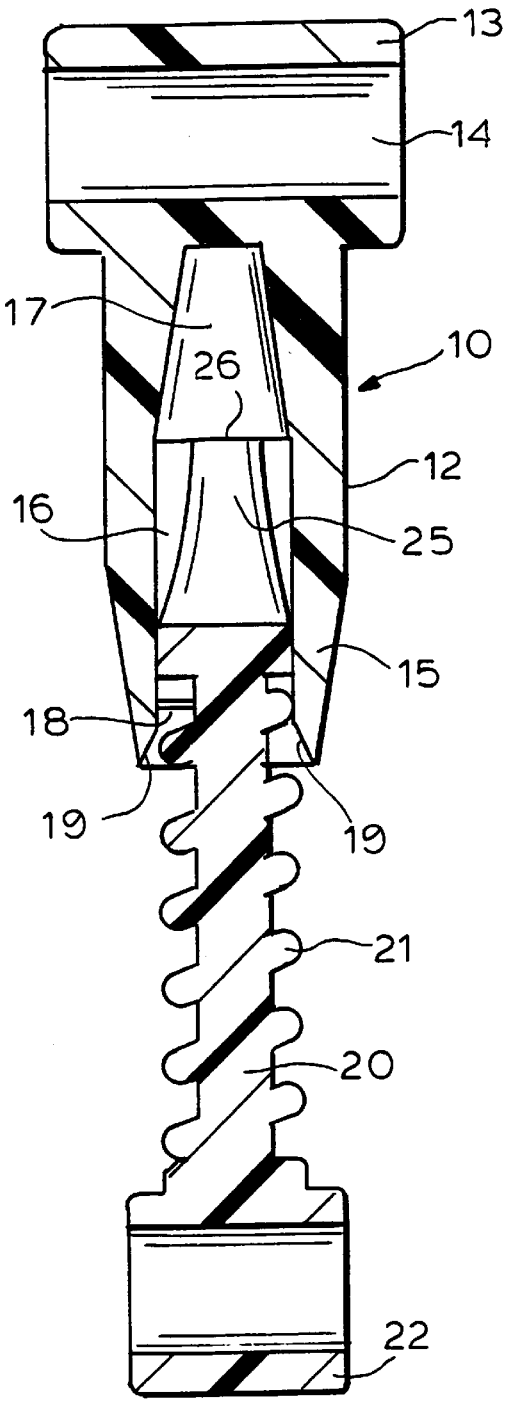
FIG. 3 is a longitudinal cross sectional view of the shock absorber device of the invention, with the parts shown in assembled relation.
Figure 4:
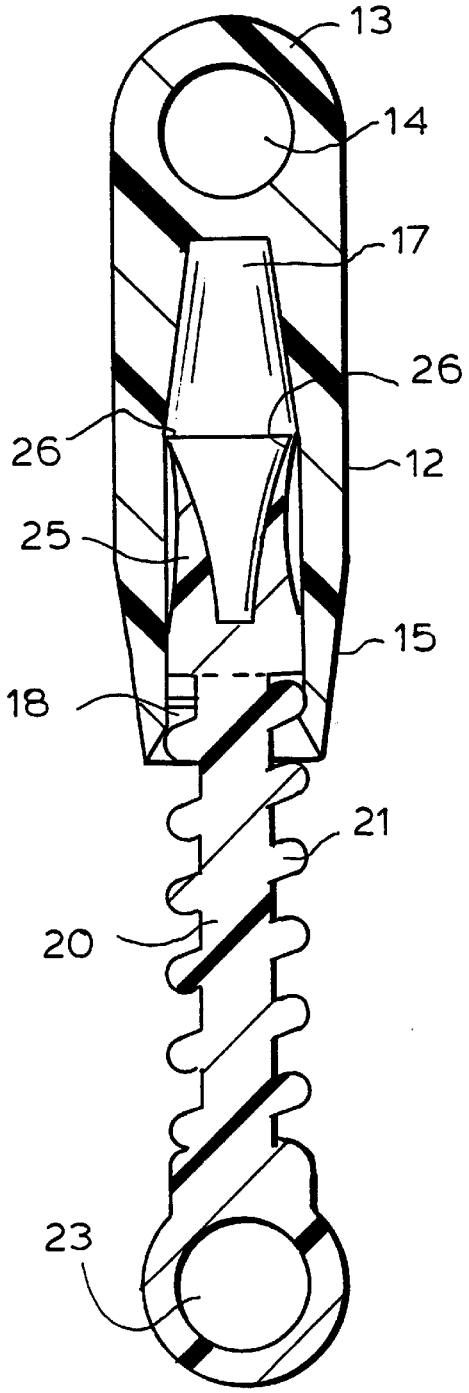
FIG. 4 is a longitudinal cross sectional view of the assembled device of FIG. 3, taken along a plane at right angles to the cross sectional plane of FIG. 3.

Referring now to the drawings, the reference numerals 10, 11 designate generally tubular sleeve and strut elements of which the shock absorber device is comprised. Each of the parts 10, 11 is of injection molded plastic construction.

In the illustrated form of the invention, the sleeve element 10 has a cylindrical body portion 12 which, in the drawings, is oriented on a vertical axis. At the upper end of the cylindrical body 12 is an upper bearing 13 formed with a cylindrical through opening 14. The through opening 14 is adapted receive a rod or similar element (not shown) of a construction set, enabling the shock absorber to be incorporated into a more comprehensive structural assembly. At its lower end 15, the body 12 may be tapered slightly for aesthetic purposes.

The sleeve element 10 is formed with a first internal portion 16 in the lower portion of the body 12, which joins at its upper end with a convergent second internal portion forming a progressive constriction 17. In an advantageous embodiment of the invention, the progressive constriction 17 has walls arranged at an included angle of approximately 20°.

The first internal portion 16 is of a first diameter. Adjacent the open lower end of the first internal portion 16, there is retention flange 18, which is of slightly smaller diameter than the first diameter of the first internal portion 16. By way of example, in a typical embodiment of the invention, the internal diameter of the first internal portion 16 may be to approximately 0.258 inch, while the internal diameter of the retention flange may be approximately 0.252 inch. A flared guide surface 19 is provided at the open end extremity of the sleeve, to facilitate assembly of the two parts of the device, and also to facilitate telescopic movement of the strut element into the sleeve during normal usage.

The strut element 11 of the new device is also preferably a one-piece injection molding of plastic material and is configured to form a rod portion 20 and a surrounding coil spring portion 21. Of course, the portions 20, 21 are part of an integral molding, and have no relative motion with respect to each other.

At the lower end of the strut element, there is a lower bearing element 22 formed with a through opening 23 for the reception of a rod or other element of a construction toy system, typically an element corresponding to a wheel-supporting axle (not shown).

At its upper end, the strut element has a guide collar 23*a* arranged to slidably cooperate with the first internal portion 16, desirably with a slight clearance (e.g. 0.002 inch) to provide for easy sliding movement. Below the guide collar is a short cylindrical neck portion 24 of slightly smaller diameter. To advantage, the guide collar 23*a* is of slightly greater diameter than the retention flange 18. For example, the guide flange may have a diameter of about 0.256 inch, while the retention flange may have an internal diameter of approximately 0.252 inch. Accordingly, in order to assemble the strut with the sleeve, the guide collar 23*a* must be forced through the region of the retention flange, after which the guide collar will slide freely within the first internal portion 16, but the strut will be retained in assembled relation with the sleeve, unless forcibly separated. Desirably, the diameter of the cylindrical neck portion 24 is slightly smaller than the diameter of the retention flange 18 such that, when the strut element is in a fully extended position in relation to the sleeve element 10, the cylindrical neck portion 24 will be received within the retention flange 18.

To advantage, the external diameter of the coil spring portion 21 of the strut is just slightly less than the inside diameter of the retention flange 18, such that the coil spring portion 21 slides freely through the retention flange, and the retention flange provides lateral support and guidance for the strut during its axial movements.

In accordance with the invention, the upper end of the strut element 11 is provided with a pair of upwardly extending resiliently displaceable tine elements 25, which are mounted in cantilever fashion at the upper end of the guide collar 23*a* and are tapered in both width and thickness as they extend upwardly and slightly divergently from the guide collar. In order to assemble the strut element 11 into the sleeve element 10, the resiliently displaceable tine elements 25 are laterally compressed to enable them to be received in the bottom opening of the sleeve. Thereafter, the upper, outer edge extremities 26 of the tine elements slide along the walls of the first internal portion 16 until, eventually, they engage the converging walls of the progressive constriction 17.

In the "normal" position of the strut 11 within the sleeve 10, the strut is fully axially extended, and the resiliently displaceable tine elements 25 are contained substantially within the first internal portion 16. When axial pressure is applied to the strut in a compressing direction, the upper, outer edge extremities 26 of the resiliently displaceable tine elements ride upwardly into the progressive constriction 17, causing the upper portions of the resiliently displaceable tine elements to be progressively deflected radially inwardly. This provides progressively increasing resistance to the axial compression of the assembled parts, as will be understood. When the compressing force is released, the action of the resiliently displaceable tine elements against the conical walls of the progressive constriction 17 causes the strut 11 to return to its axially extended rest position.

When the shock absorber device of the invention is installed in a toy vehicle, the upper bearing 13 at the upper end of the sleeve element is pivotally mounted on the vehicle, and the lower bearing element 22 at the lower end of the strut element is attached to a wheel axle. The device provides a realistic looking shock absorber arrangement which, in addition, performs a rather realistic function in terms of providing for spring mounting of the wheels of the toy vehicle.

The device of the invention is constructed of only two molded parts, which can be included separately in a construction toy kit and assembled and disassembled by the user. Typically, once assembled, the shock absorber device would be retained in its assembled condition and would simply be installed in and removed from vehicle structures without disassembly of the device itself.

Although materials of construction are not known to be critical, it is advantageous to mold the sleeve element 10 of nylon plastic, while the strut element 11 advantageously is formed of an acetal copolymer plastic material sold under the trademark "Celcon".

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A shock absorber for toy vehicles, which comprises (a) a tubular sleeve element having a sleeve axis, an open end, and a second end remote from said open end, (b) a strut element having an inner end portion slidably received within said tubular sleeve element for guided telescopic movement therein and having an outer end portion projecting beyond said tubular sleeve element at said open end thereof, (c) said tubular sleeve element being formed internally with a first internal portion having a first diameter at least as large as a diameter of said strut inner end portion, and a second internal portion adjoining said first portion at said second end thereof, (d) said second internal portion forming a progressive constriction in a direction away from said open end, (e) the inner end portion of said strut having resiliently displaceable elements slidably received within said first internal portion and slidably movable into said second internal portion when said strut element is telescopically displaced axially within said tubular sleeve element in a first direction toward said second end, (f) said resiliently displaceable elements being progressively displaced radially inwardly toward said axis by said progressive constriction upon axial displacement of said strut element in said first direction, to elastically arrest such axial displacement.

2. A shock absorber according to claim 1, wherein (a) said strut element has, at said outer end thereof, a bearing portion disposed at right angles to said strut axis.

3. A shock absorber according to claim 2, wherein (a) said tubular sleeve element has, at said second end thereof, a bearing portion disposed at right angles to said sleeve axis.

4. A shock absorber according to claim 1, wherein (a) the outer end portion of said strut element is formed with a simulated coil spring configuration extending into said open end of said tubular sleeve element.

5. A shock absorber according to claim 1, wherein (a) said strut element has, adjacent said resiliently displaceable elements, a guide collar of a predetermined diameter adapted for slidable movement within the first internal portion of said of said tubular sleeve element, and (b) said tubular sleeve element has, adjacent its open end, a retention flange of slightly smaller diameter than said guide collar, (c) at least one of said guide collar or retention flange being formed of a resilient plastic material accommodating elastic displacement thereof during axial assembly of said strut element into said tubular sleeve element and thereafter resisting axial separation of said elements.

6. A shock absorber according to claim 4, wherein (a) said simulated coil spring configuration has an outer diameter corresponding generally with said first diameter of the first internal portion of said sleeve element, whereby said coil spring configuration functions as a guide means to maintain said strut element in axial alignment with said sleeve element during relative axial movements of said elements.

7. A shock absorber according to claim 1, wherein (a) said resiliently displaceable elements comprise a pair of cantilever supported leaf spring elements extending generally longitudinally from the inner end portion of said strut element, (b) said leaf spring elements having end portions flared laterally outward to initial positions in which the distance between outer walls of said flared end portions is at least slightly greater than said first diameter of the first internal portion of said tubular sleeve element.

8. A shock absorber according to claim 1, wherein (a) the second internal portion of said tubular sleeve element is formed with conical walls comprising said progressive constriction.

* * * * *